United States Patent [19]

Elkin

[11] Patent Number: 4,874,446

[45] Date of Patent: Oct. 17, 1989

[54] METHOD OF MAKING A JEWELRY DISPLAY CARD

[75] Inventors: Alfred A. Elkin, Pawtucket, R.I.; Sylvestre M. Costa, Seekonk, Mass.

[73] Assignee: Plastic Development, Inc., Pawtucket, R.I.

[21] Appl. No.: 208,977

[22] Filed: Jun. 20, 1988

[51] Int. Cl.[4] ..... B32B 31/20; A45C 11/16

[52] U.S. Cl. ..... 156/66; 40/642; 156/292; 156/308.4; 206/557; 206/566; 248/489; 428/81; 428/159; 428/319.7

[58] Field of Search ..... 40/584, 615, 642, 657; 156/66, 292, 308.4; 206/557, 566; 248/489; 428/81, 157, 159, 318.4, 319.7

[56] References Cited

U.S. PATENT DOCUMENTS

| | | | |
|---|---|---|---|
| 1,618,561 | 2/1927 | Warner | 206/566 |
| 1,752,246 | 3/1930 | Flier | 206/566 X |
| 2,380,052 | 7/1945 | Koller | 206/566 X |
| 3,142,124 | 7/1964 | Ownbey | 248/489 X |
| 4,411,944 | 10/1983 | Moore | 428/319.7 X |

*Primary Examiner*—Robert A. Dawson
*Assistant Examiner*—James J. Engel, Jr.
*Attorney, Agent, or Firm*—Salter & Michaelson

[57] ABSTRACT

A method of making a jewelry display card includes the steps of welding a plastic hanger member on the rear side of a plastic card member so that the hanger member is spaced inwardly by at least approximately one-sixteenth of an inch from the perimeter of the card member, overlaying a foam pad on the front side of the card member, overlaying a flexible, plastic sheet on the foam pad and welding the flexible, plastic sheet to the card member along a welded seam which extends around substantially the entire perimeter of the card member.

4 Claims, 2 Drawing Sheets

METHOD OF MAKING A JEWELRY DISPLAY CARD

BACKGROUND AND SUMMARY OF THE INVENTION

The instant invention relates to jewelry display apparatus and more particularly to a method of making a jewelry display card and to the display card thereby formed.

Various types of jewelry display cards have been heretofore available, and many of the heretofore available types of display cards have been found to be effective for supporting various jewelry items in retail displays. In this regard, hanger-type display cards comprising a main card member which is adapted for supporting one or more jewelry items thereon and a hanger member which extends rearwardly from the upper edge of the card member for supporting the card member on a hanger, such as a horizontal hanger bar, have been found to be highly effective for displaying various types of jewelry items in retail displays. Display cards of a type commonly referred to as puff-pad cards have also been found to be highly effective for supporting various types of jewelry items in retail displays. Puff-pad type display cards generally comprise a substantially flat card member, a soft foam pad on the front side of the card member, and a flexible, plastic sheet on the foam pad which is welded to the card member around substantially the entire perimeter of the card member. Puff-pads cards have often been found to be preferable to other types of display cards since the padded front surfaces thereof provide rich, softly padded backgrounds for jewelry items displayed thereon. However, while both hanger type cards and puff-pad cards have been heretofore available, hanger-type puff-pad cards having the combined features of these two types of cards have not been heretofore available. In this connection, this is because the heretofore available methods have not been capable of both welding a plastic sheet and a foam pad to the front side of a card member and welding a hanger member to the rear side of the card member without either damaging the foam pad and/or the plastic sheet or producing an incomplete seam between the plastic sheet and the card member.

The instant invention provides an effective method which, for the first time, makes it possible to effectively construct a hanger-type puff-pad card comprising a substantially flat card member, a hanger member which is welded to the rear side of the card member, a foam pad on the front side of the card member, and a flexible plastic sheet on the front side of the foam pad which is welded to the card member around substantially the entire perimeter of the card member. Specifically, the method of the instant invention comprises the steps of positioning an elongated plastic hanger member on the rear side of a substantially flat card member and welding the hanger member to the card member. In this regard, the hanger member is of generally U-shaped, sectional configuration, and it includes an elongated, substantially flat front flange portion having an upper end, an upper portion which extends rearwardly from the upper end of the flange portion, and a rear portion which extends downwardly from the upper portion. The flange portion of the hanger member is welded to the rear side of the card member so that it is spaced inwardly from the perimeter of the card member by at least approximately one-sixteenth of an inch. The method further comprises the steps of thereafter overlaying a foam pad and a flexible plastic sheet on the front side of the card member and welding the plastic sheet to the card member around substantially the entire perimeter of the card member in order to secure the plastic sheet and the foam pad to the front side of the card member. In this connection, the plastic sheet is preferably welded to the card member by forming a continuous welded seam between the plastic sheet and the card member having a width of at least approximately one-sixteenth of an inch. The card member, the hanger member, the foam pad and the plastic sheet are preferably all made of vinyl plastic materials, such as PVC plastic materials, and the hanger member and the plastic sheet are preferably welded to the card member by dielectric welding. Further, the foam pad is preferably dimensioned so that it substantially covers the front side of the card member, and the plastic sheet is preferably welded to the card member through the foam pad. However, it is not necessary that the foam pad be either the same size as the card member or that it be welded to the card member.

It has been found that the method of the instant invention can be effectively utilized to form hanger-type puff-pad display cards. In this regard, because the hanger member is secured to the rear side of the card member before the foam pad and the flexible plastic sheet are secured to the front side of the card member, the hanger member can be secured to the card member without causing damage to the foam pad and/or the flexible plastic sheet. Further, because the hanger member is secured to the card member so that it is spaced inwardly from the perimeter of the card member, the rear perimeter portions of the card member are effectively engageable by a welding apparatus in order to weld the flexible sheet to the front side of the card member around substantially the entire perimeter of the card member. Hence, by practicing the method steps of the subject invention in the proper sequence and by positioning the hanger member in the appropriate orientation on the rear side of the card member, both the hanger member and the plastic sheet can be dielectrically welded to the card member to produce an effective hanger-type puff-pad card.

Accordingly, it is a primary object of the instant invention to provide an effective method of making a hanger-type puff-pad display card.

Another object of the instant invention is to provide a method of both welding a plastic hanger element to the rear side of a plastic card member and welding a foam pad and a flexible plastic sheet to the front side of the card member around substantially the entire perimeter of the card member.

An even further object of the instant invention is to provide an effective hanger-type puff-pad display card for jewelry.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
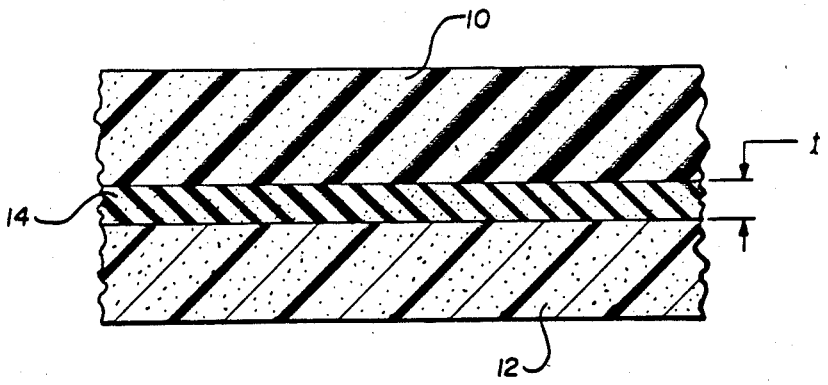
FIG. 1 is a front perspective view of the display card of the instant invention.
Figure 2:
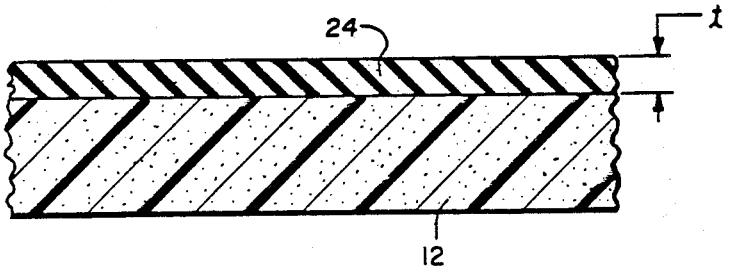
FIG. 2 is a rear perspective view thereof.

Referring now to the drawings, the method of the subject invention is illustrated in FIGS. 3–10, and the display card of the subject invention as made by the method is illustrated and generally indicated at 10 in FIGS. 1 and 2. The display card 10 includes a substantially rectangular card member 12, a hanger member generally indicated at 14 on the rear side of the card member 12, and a puff pad assembly 16 on the front side of the card member 12, which provides a rich, soft, padded background for jewelry items displayed on the card 10.

Figure 3:
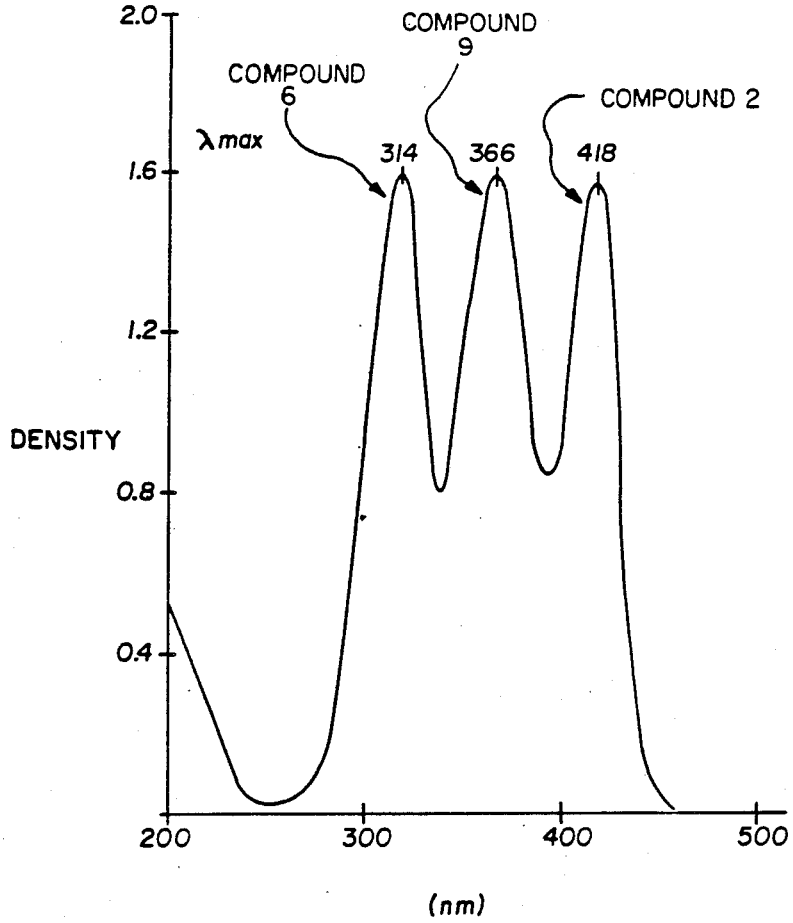
FIGS. 3 and 4 are sequential views illustrating the steps of assembling and welding the hanger member on the card member.
Figure 1:
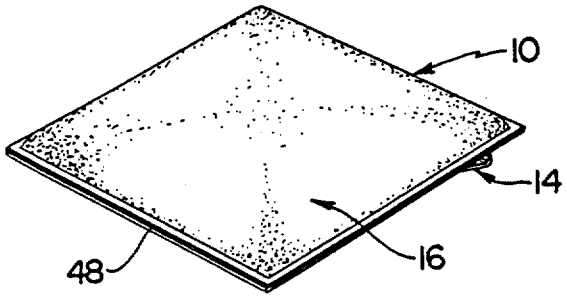
Figure 2:
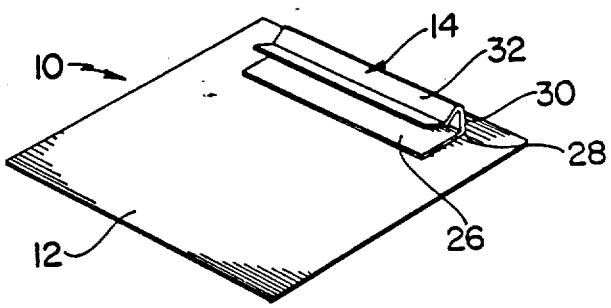
Figure 3:
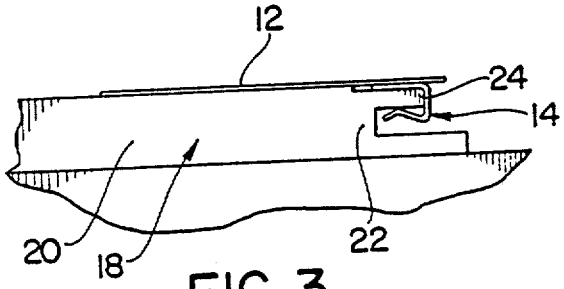
Figure 4:
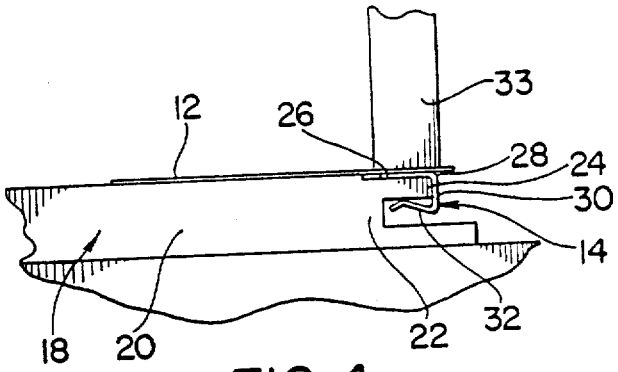
Figure 5:
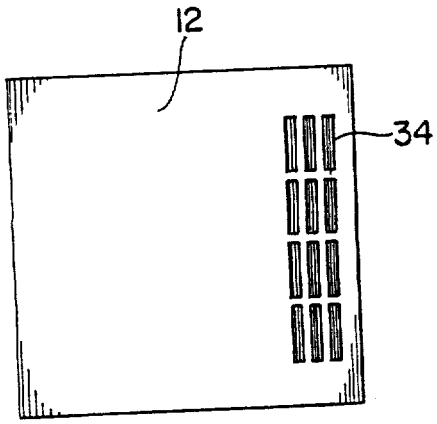
FIG. 5 is a front plan view of the card member after the hanger member has been welded thereto.
Figure 6:
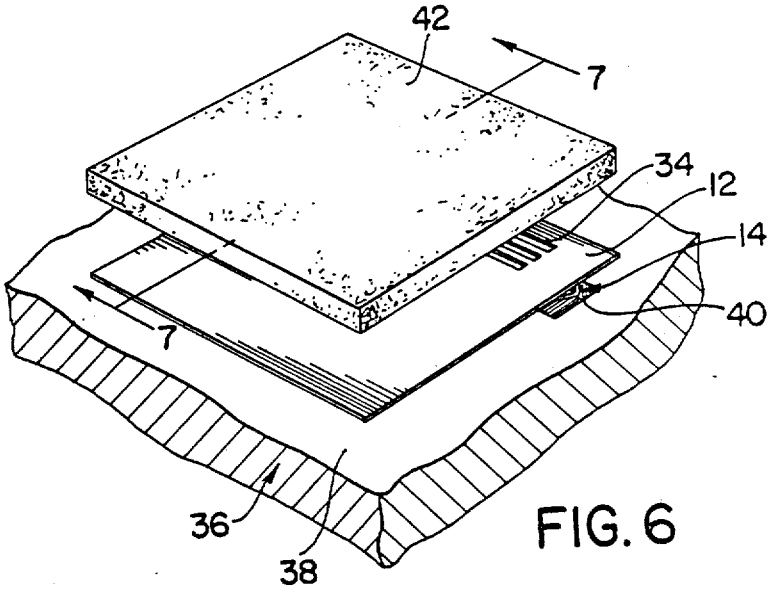
FIG. 6 is a perspective view of the step of assembling the foam pad with the card member and the hanger member on a fixture.
Figure 7:
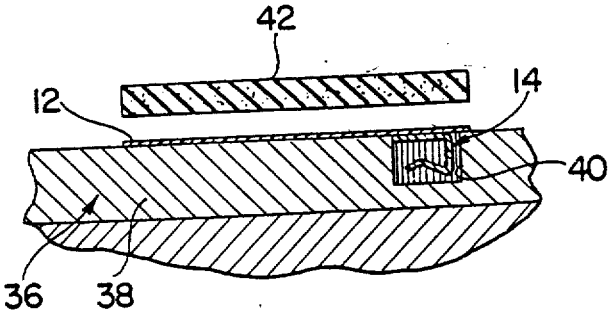
FIG. 7 is a sectional view taken along line 7—7 in FIG. 6.
Figure 8:
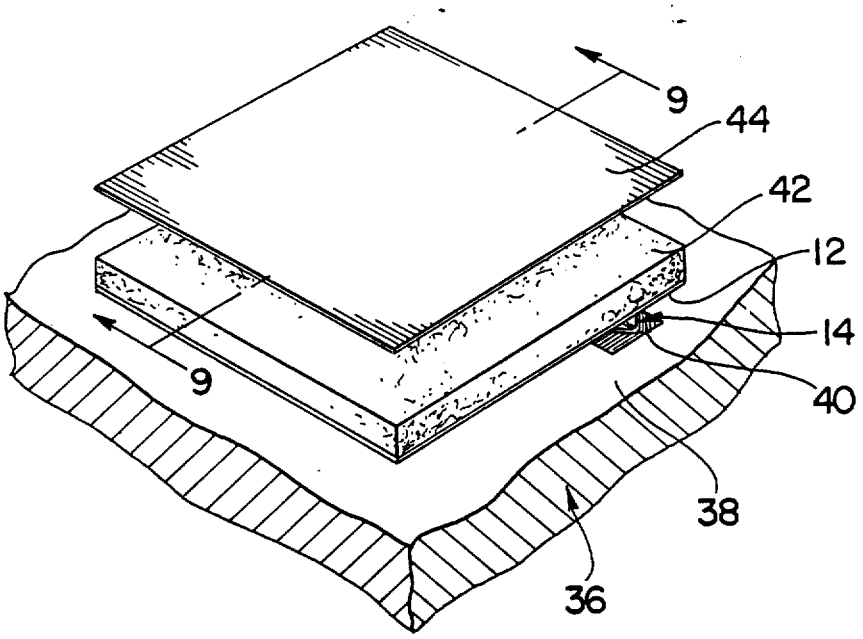
FIG. 8 is a perspective view of the step of assembling a plastic sheet on the assembly illustrated in FIGS. 6 and 7.
Figure 9:
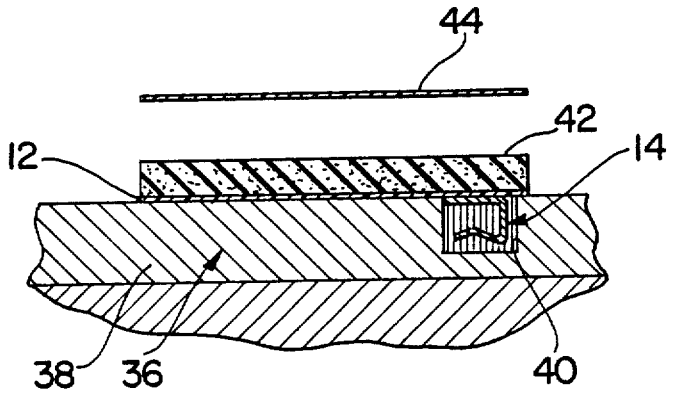
FIG. 9 is a sectional view taken along line 9—9 in FIG. 8.

As illustrated in FIG. 3, the first step of the method is carried out by assembling a hanger member 14 and a card member 12 on a first conductive metal fixture 18. In this regard, the first fixture 18 preferably comprises a main portion 20 having a substantially flat upper surface thereon, and a notched end portion 22 including an upper arm 24 which is substantially parallel to but spaced downwardly slightly from the upper surface of the main portion 20. The card member 12 preferably comprises a substantially flat, plastic card which is preferably made of a vinyl plastic, such as PVC plastic. The hanger member 14 is preferably extruded from a vinyl plastic, such as PVC plastic, in an elongated configuration. The hanger member is preferably of generally U-shaped, sectional configuration, and it includes an elongated substantially flat front flange portion 26 having an upper end 28, an upper portion 30 which extends rearwardly from the upper end 28 and a rear portion 32 which extends downwardly from the upper portion 30. The card member 12 and the hanger member 14 are assembled on the first fixture 18 so that the card member 12 is supported on the upper surface of the main portion 20 and so that the hanger member 14 is received on the arm 24. Further, the card member 12 is assembled with the hanger member 14 so that the card member 12 is overlayed on the flange portion 26 of the hanger member 14 and so that the hanger member 14 is spaced inwardly from the perimeter of the card member 12 by at least approximately one-sixteenth of an inch. After the card member 12 and the hanger member 14 have been assembled on the fixture 18 in this manner, the hanger member 14 is welded to the card member 12 in the manner illustrated in FIG. 4. Specifically, a first welding unit 33, which preferably comprises a dielectric welding unit, is applied to the front side of the card member 12 in the area opposite the hanger member 14, and a radio frequency current is applied to the welding unit 33 in order to dielectrically weld the card member 12 to the hanger member 14 with a plurality of welds 34. In this regard, it will be understood that the use of other types of welding apparatus such as thermal or ultrasonic welding apparatus in accordance with the method is also contemplated. In any event, as will be noted from FIG. 5, the card member 12 is actually melted or softened during the welding operation in the areas of the welds 24, and therefore the front side of the card member 12 is defaced somewhat during the welding step.

Figure 10:
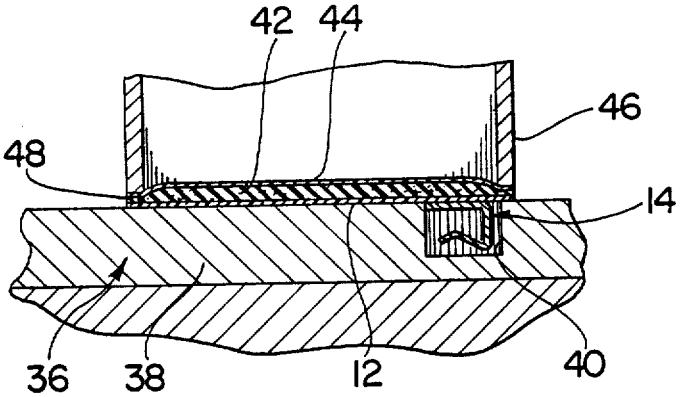
FIG. 10 is a sectional view illustrating the step of welding the plastic sheet to the card member.

Once the hanger member 14 has been welded to the backside of the card member 12, the card member 12 is removed from the fixture 18 and assembled on a second fixture generally indicated at 36. The second fixture 36 is also made of a conductive metal and it includes a main portion 38 having a substantially flat upper surface thereon, and an elongated, upwardly opening slot 40 which is dimensioned for receiving the hanger member 14 therein and which has a length which is at least one-eight of an inch less than the width of the card member 12. The card member 12 and the hanger member 14 are assembled on the fixture 36 so that the card member 12 is supported on the upper surface of the main portion 38 with the hanger member 14 received in the slot 40, and thereafter the puff-pad assembly 16 comprising a foam pad 42 and a flexible plastic sheet 44 is assembled on the frontside of the card member 12. Specifically, the foam pad 42 is overlayed on the front surface of the card member 12, and the flexible plastic sheet 44 is overlayed on the foam pad 42. The foam pad 42 preferably comprises a soft pad made from a vinyl plastic foam, such as PVC foam, and the flexible plastic sheet 44 is preferably also made from a vinyl plastic, such as PVC; although it preferably has a decorative flocked outer surface texture. The foam pad 42 and the flexible plastic sheet 44 are preferably dimensioned so that when they are overlayed on the card member 12, they cover the entire front surface thereof. After the foam pad 42 and the flexible plastic sheet 44 have been overlayed on the card member 12, the flexible plastic sheet 44 is welded to the card member 12 around substantially the entire perimeter of the card member 12 in the manner illustrated in FIG. 10. Specifically, a second dielectric welding unit 46 is brought into engagement with the perimeter portions of the front surface of the flexible plastic sheet 44, and the flexible plastic sheet 44 and the foam pad 42 are pressed against the front side of the card member 12 around the entire perimeter of the card member 12 with the second welding unit 46 as illustrated in FIG. 10. The second welding unit 46 is then energized to dielectrically weld the plastic sheet 44 and the foam pad 42 to the card member 12 along seams 48 having widths of at least approximately one-sixteenth of an inch which extend continuously around the perimeter portions of the card member 12. In this regard, as the seams 48 are formed around the perimeter of the card member 12, the portions of the foam pad 42 which are captured between the plastic sheet 44 and the card member 12 are melted and at least partially absorbed into the card member 12 and the sheet 44 as the welded seams 48 are formed between the sheet 44 and the card member 12. Further, any excess overlapping portions of the pad 42 or the sheet 44 are inherently trimmed off as the sheet 44 and the pad 42 are melted during the welding operation. Again, however, it should be noted that other types of welding processes, such as thermal welding or ultrasonic welding, can be utilized to weld the sheet 44 to the card member 12. In any event, in the method as herein illustrated, after the seams 48 have been fully formed, the second welding unit 46 is disengaged from the sheet 44, and the finished card 10 is removed from the fixture 36.

It is seen therefore that the instant invention provides an effective method of manufacturing a hanger-type puff-pad display card for supporting jewelry items and the like in a retail display. In this regard, because the hanger member 14 is welded to the rear side of the card member 12 before the foam pad 42 and the plastic sheet 44 are welded to the front side of the card member 12, the plastic sheet 44 and the foam pad 42 are not damaged during the initial welding operation. Further, because the hanger member 14 is positioned in inwardly spaced relation to the perimeter of the card member 12, the hanger member 14 does not interfere with the second welding operation wherein the foam pad 42 and the plastic sheet 44 are welded to the card member 12. Hence, it is seen that the instant invention provides an effective method which represents a significant advancement in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A method of making a jewelry display card comprising:

(a) assembling an elongated plastic hanger member on the rear side of a substantially flat plastic card member, said hanger member being of generally U-shaped sectional configuration and including an elongated, substantially flat front flange portion having an upper end, an upper portion which extends rearwardly from the upper end of said flange portion and a rear portion which extends downwardly from said upper portion;

(b) welding the flange portion of said hanger member to the rear side of said card member so that said hanger member is spaced inwardly from the perimeter of said card member by at least approximately one-sixteenth of an inch;

(c) thereafter overlaying a foam pad on the front side of said card member;

(d) overlaying a flexible plastic sheet on said foam pad; and (e) welding said plastic sheet to secure said plastic sheets to said card member around substantially the entire perimeter of said card member.

2. In the method of claim 1, said step of welding said plastic sheet further characterized as welding said plastic sheet to said card member by forming a welded seam therebetween having a width of at least approximately one-sixteenth of an inch, said seam extending substantially entirely around the perimeter of said card member.

3. In the method of claim 1, said card member, said hanger member, said foam pad and said plastic sheet being made of vinyl plastic materials.

4. In the method of claim 2, said foam pad substantially covering said card member, said plastic sheet being welded to said card member through said foam pad.

* * * * *

UNITED STATES PATENT AND TRADEMARK OFFICE

CERTIFICATE OF CORRECTION

PATENT NO. : 4,874,446

DATED : Oct. 17, 1989

INVENTOR(S) : Alfred A. Elkin, et al.

It is certified that error appears in the above-identified patent and that said Letters Patent is hereby corrected as shown below:

The title page should be deleted to appear as per attached title page.

The sheets of drawings should be deleted to be replaced with the sheets of drawings as shown on the attached pages.

Signed and Sealed this

Sixteenth Day of October, 1990

*Attest:*

HARRY F. MANBECK, JR.

*Attesting Officer*

*Commissioner of Patents and Trademarks*

United States Patent [19]

Elkin

[11] Patent Number: 4,874,446

[45] Date of Patent: Oct. 17, 1989

[54] METHOD OF MAKING A JEWELRY DISPLAY CARD

[75] Inventors: Alfred A. Elkin, Pawtucket, R.I.; Sylvestre M. Costa, Seekonk, Mass.

[73] Assignee: Plastic Development, Inc., Pawtucket, R.I.

[21] Appl. No.: 208,977

[22] Filed: Jun. 20, 1988

[51] Int. Cl.[4] ..... B32B 31/20; A45C 11/16

[52] U.S. Cl. ..... 156/66; 40/642; 156/292; 156/308.4; 206/557; 206/566; 248/489; 428/81; 428/159; 428/319.7

[58] Field of Search ..... 40/584, 615, 642, 657; 156/66, 292, 308.4; 206/557, 566; 248/489; 428/81, 157, 159, 318.4, 319.7

[56] References Cited

U.S. PATENT DOCUMENTS

| | | | |
|---|---|---|---|
| 1,618,561 | 2/1927 | Warner | 206/566 |
| 1,752,246 | 3/1930 | Flier | 206/566 X |
| 2,380,052 | 7/1945 | Koller | 206/566 X |
| 3,142,124 | 7/1964 | Ownbey | 248/489 X |
| 4,411,944 | 10/1983 | Moore | 428/319.7 X |

*Primary Examiner*—Robert A. Dawson
*Assistant Examiner*—James J. Engel, Jr.
*Attorney, Agent, or Firm*—Salter & Michaelson

[57] ABSTRACT

A method of making a jewelry display card includes the steps of welding a plastic hanger member on the rear side of a plastic card member so that the hanger member is spaced inwardly by at least approximately one-sixteenth of an inch from the perimeter of the card member, overlaying a foam pad on the front side of the card member, overlaying a flexible, plastic sheet on the foam pad and welding the flexible, plastic sheet to the card member along a welded seam which extends around substantially the entire perimeter of the card member.

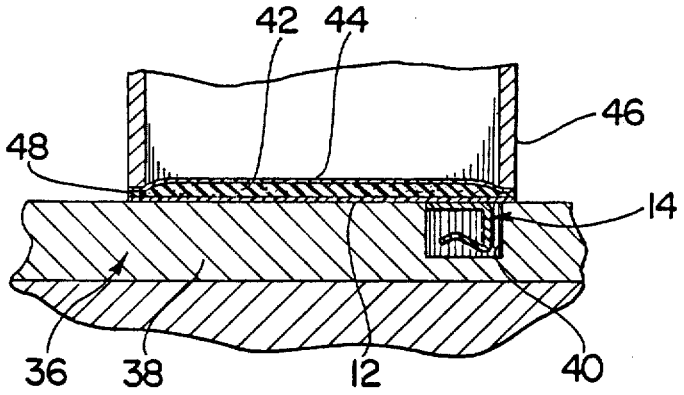

4 Claims, 2 Drawing Sheets